United States Patent [19]

Faber et al.

[11] 4,377,275

[45] Mar. 22, 1983

[54] RAILING CONSTRUCTION

[76] Inventors: Robert V. Faber, 1905 NE. 49th Ave., Portland, Oreg. 97213; Ronald D. Sylwester, P.O. Box 1404, Lake Grove, Oreg. 97034

[21] Appl. No.: 229,719

[22] Filed: Jan. 29, 1981

[51] Int. Cl.[3] ..... E04H 17/14; F16B 39/00

[52] U.S. Cl. ..... 256/69; 411/177

[58] Field of Search ..... 256/69, 68, 65, 59, 256/21, 22, 24; 411/176, 177, 179, 184, 187

[56] References Cited

U.S. PATENT DOCUMENTS

| | | | |
|---|---|---|---|
| 945,737 | 1/1910 | Anderson | 411/177 |
| 2,102,558 | 12/1937 | Johnson | 411/177 |
| 3,050,287 | 8/1962 | Bloch et al. | 256/19 X |
| 3,804,374 | 4/1974 | Thom | 256/59 |
| 4,175,883 | 11/1979 | Lemelson | 256/65 X |

FOREIGN PATENT DOCUMENTS

| | | | |
|---|---|---|---|
| 1248270 | 5/1961 | Fed. Rep. of Germany | 256/65 |
| 6055 | of 1908 | United Kingdom | 411/179 |
| 1244304 | 8/1971 | United Kingdom | 256/59 |

*Primary Examiner*—Richard J. Scanlan, Jr.
*Attorney, Agent, or Firm*—James D. Givnan, Jr.

[57] ABSTRACT

A railing structure including a banister and supporting balusters both components bored to receive a fastener assembly. A nut element of the fastener assembly is permanently secured in place. Nut element prongs are at least partially embedded within a railing component with a sleeve portion of the nut element being in register with a bore of the component.

1 Claim, 4 Drawing Figures

RAILING CONSTRUCTION

BACKGROUND OF THE INVENTION

The present invention pertains to railings comprising balusters and banisters for installation in homes as well as commercial building.

Current practice in railing construction, for the most part, entails the efforts of a carpenter who constructs the railing in a customized manner to meet the railing requirements of a specific home or building. The individual dimensioning, cutting and shaping of the railing constitutes a lengthy task from a man hour standpoint and hence results in considerable cost. Further contributing to railing cost is the assembly thereof which customarily uses screw type fasteners for joining wooden railing components.

Another drawback to known railing construction is the difficulty encountered in partial disassembly to replace damaged railing components.

A still further drawback to known railing structures is the difficulty of railing assembly contributing to job man hours and hence railing cost.

SUMMARY OF THE PRESENT INVENTION

The present invention is embodied within the combination of a baluster and banister utilizing a fastener assembly partially installed in place within the baluster during baluster production.

In the present railing construction, a baluster is recessed at its upper end to receive and support the banister against both horizontal and vertical loads without subjecting the fastener assembly to shear loads. The uppermost end of each baluster is bored, and counterbored to receive the fastener assembly extending therethrough. A nut element of the fastener assembly is of the type permanently secured within a counterbore and is most economically installed therein during plant manufacture of the baluster. The fastener assembly is concealed from view by buttons or caps seated within the bore openings.

Important objectives of the present invention include the provision of railing construction lending itself to low cost manufacture by reason of same being accomplished within a plant on a production line basis during which a fastener component may be permanently installed within the railing baluster; the provision of railing construction utilizing fastener assemblies readily detachable from the baluster and banister to permit substitution of either or both to replace damaged counterparts; the provision of railing construction greatly reducing the on-site efforts of a carpenter or carpenters to effect an overall reduction of costs in railing fabrication and installation.

DETAILED DESCRIPTION OF THE PREFERRED EMBODIMENTS

Figure 1:
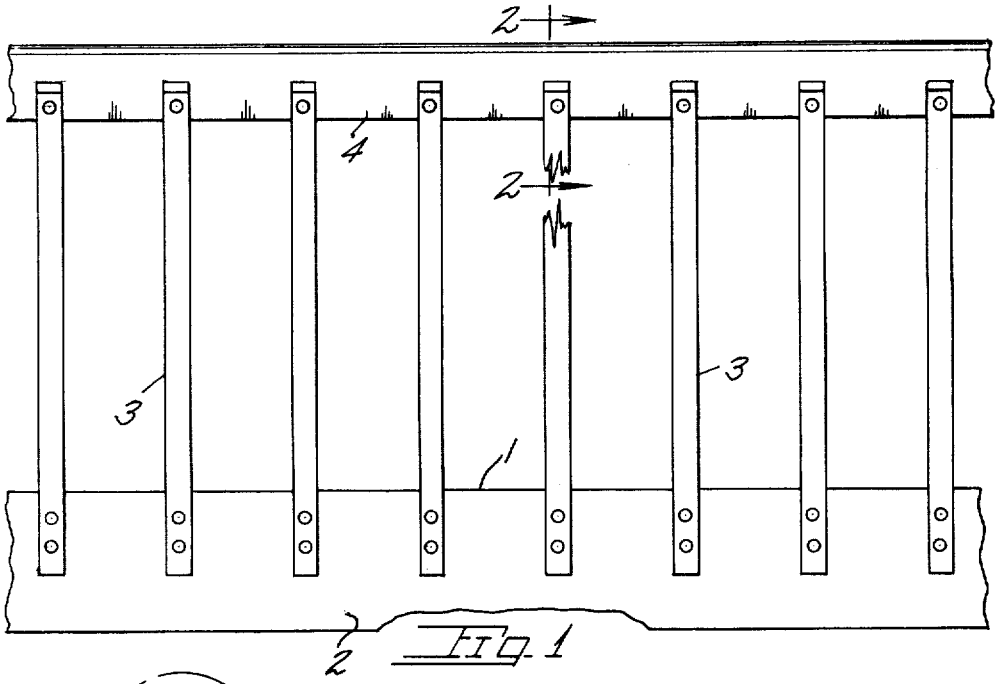
FIG. 1 is a front elevational view of a fragment of a railing structure.
Figure 3:
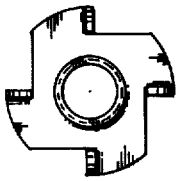
FIG. 3 is a front elevational view of a nut element used in the present invention.

With continuing attention to the drawing, the reference numeral 1 indicates a horizontal structure which may be embodied within a deck, porch, walkway, or the like of a house or building. Typically, such structures include an outermost horizontal structural member at 2 to which are suitably secured the upright components, or balusters, indicated at 3 and which comprise part of the present railing construction. A banister at 4 is jointly supported by the upper end of each baluster in the following described manner.

Figure 2:
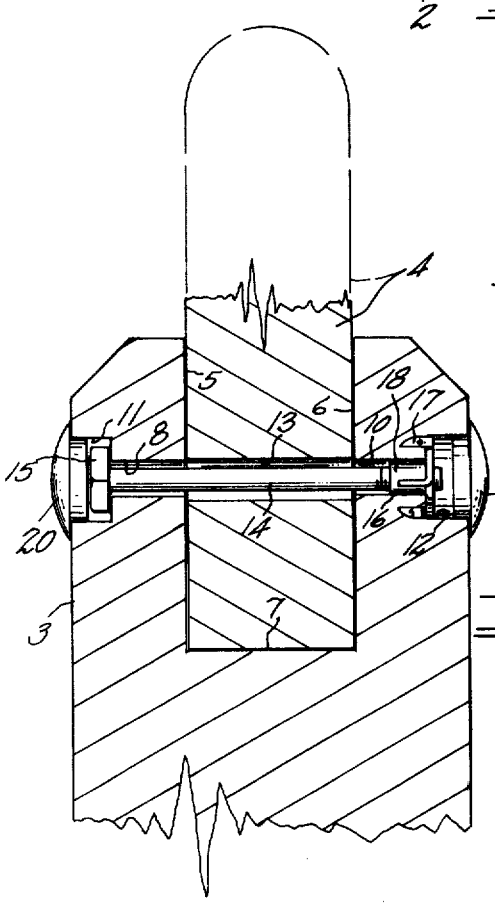
FIG. 2 is a vertical sectional view taken along line 2—2 of FIG. 1 with fragments broken away.

With particular attention to FIG. 2, the upper end of each baluster 3 has internal vertical walls at 5 and 6 and a horizontal wall surface 7 which jointly define an upwardly opening baluster receiving recess. Additionally, the upper end of each baluster defines aligned bores at 8 and 10 with counterbores at 11 and 12 being axially aligned therewith.

The banister 4 is transversely bored at intervals at 13 the latter being aligned with the baluster bore when subsequently seated in place thereon. Bores 13 may be formed somewhat oversize to facilitate insertion of a later described fastener assembly component.

A fastener assembly includes a bolt 14 having a head 15 the latter adapted to seat within counterbore 11 of the baluster. The opposite end of the bolt 14 is threadedly engageable with a nut element 16 secured in place both within counterbore 12 and bore 10 of the baluster. The nut element includes rigid prongs 17 which are, at least partially, embedded within and permanently secured to the baluster during baluster manufacture. A threaded collar portion 18 of the nut element is slidably received within bore 10 during securement of the nut element.

The fastener assembly as well as counterbores 11 and 12 are preferably closed from view by caps 20 and 21 which include an annular portion for frictional engagement with counterbore surfaces.

Figure 4:
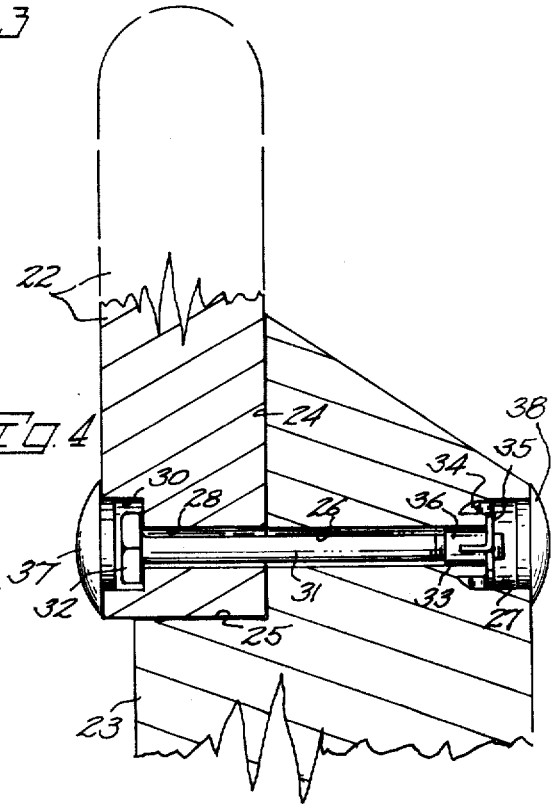
FIG. 4 is a view similar to FIG. 2 and showing a modified railing structure.

With attention now to FIG. 4, the upper end of a modified baluster at 23 supports a banister 22 and has vertical and horizontal surfaces at 24 and 25 which define a baluster recess open at one side. The baluster bore at 26 is concentric with a counterbore 27. Similarly, a banister bore at 28 is concentric with a baluster counterbore at 30 with the bores and counterbores being in axial alignment.

A fastener assembly includes a bolt 31 having a head 32 seated in place within counterbore 30. A nut element at 33 includes rigid, pointed prongs 34 each being upset from a planar base 35 of the nut element. Integral with said base is a bore insertable sleeve 36 internally threaded to receive the bolt end. As in the preferred form of the invention, nut element 33 is at least partially seated within the baluster to the extent that during baluster shipment and handling the nut element is retained against loss.

Caps at 37 and 38 close the baluster and banister counterbores to enhance rail appearance.

Installation of the present railing structure is greatly simplified by reason of the baluster and banister being substantially completed in a production line method at a manufacturing plant. Subsequent to attachment of the balusters in a spaced apart manner along the deck, porch, walkway, etc., the banister is lowered into place within each baluster recess with securement thereto effected simply by installation of bolts 14. Accordingly, securement of the banister is accomplished entirely from one side of the railing to preclude difficult "blind" assembly work at the unseen side of the baluster.

While we have shown but a few embodiments of the invention it will be apparent to those skilled in the art that the invention may be embodied still otherwise without departing from the spirit and scope of the invention.

Having thus described the invention, what is desired to be secured under a Letters Patent is:

We claim:

1. Railing construction comprising in combination, a baluster having a pair of opposed internal vertical wall surfaces and an internal horizontal wall surface extending therebetween defining a recess at its upper end, a banister positioned within said recess in surfacial abutment with said vertical and horizontal wall surfaces, said baluster and said banister defining bores in axial alignment with one another when the banister is supported in place within said baluster recess, said baluster also defining a pair of inwardly directed counterbores, a fastener assembly within said bores and including a head and a nut element one each disposed within a baluster counterbore, said nut element including baluster engaging prongs and permanently in place within the baluster, and said fastener assembly biasing said baluster vertical wall surfaces into engagement with said banister with loads imparted to the railing banister being transferred directly to the baluster via abutting banister and baluster surfaces whereby shear loading of the fastener assembly is avoided.

* * * * *